US010359162B2

(12) United States Patent
Terumichi

(10) Patent No.: US 10,359,162 B2
(45) Date of Patent: Jul. 23, 2019

(54) LIGHTING DEVICE WITH OFF-AXIS REFLECTOR AND LIGHT SOURCE

(71) Applicant: MODULEX INC., Tokyo (JP)

(72) Inventor: Goro Terumichi, Tokyo (JP)

(73) Assignee: MODULEX INC., Tokyo (JP)

( * ) Notice: Subject to any disclaimer, the term of this patent is extended or adjusted under 35 U.S.C. 154(b) by 0 days.

(21) Appl. No.: 15/506,936

(22) PCT Filed: Aug. 27, 2015

(86) PCT No.: PCT/JP2015/074312
§ 371 (c)(1),
(2) Date: Feb. 27, 2017

(87) PCT Pub. No.: WO2016/031943
PCT Pub. Date: Mar. 3, 2016

(65) Prior Publication Data

US 2017/0254491 A1 Sep. 7, 2017

(30) Foreign Application Priority Data

Aug. 28, 2014 (JP) ..... 2014-174609

(51) Int. Cl.
*F21V 21/04* (2006.01)
*F21S 8/02* (2006.01)
(Continued)

(52) U.S. Cl.
CPC ..... *F21S 8/026* (2013.01); *F21V 7/06* (2013.01); *F21V 7/08* (2013.01); *F21V 7/09* (2013.01);
(Continued)

(58) Field of Classification Search
CPC ..... F21V 7/0058; F21V 14/04; F21V 21/04; F21V 21/041; F21Y 2105/00; F21Y 2105/10; F21Y 2105/12; F21S 8/026
See application file for complete search history.

(56) References Cited

U.S. PATENT DOCUMENTS 3,643,089 A * 2/1972 Marantz ..... F21V 21/04 362/217.02
4,564,888 A * 1/1986 Lewin ..... F21V 7/005 362/147
(Continued)

FOREIGN PATENT DOCUMENTS

EP 2322847 A2 5/2011
JP H05-347105 A 12/1993
(Continued)

OTHER PUBLICATIONS

The Extended Search Report (ESR) dated Feb. 27, 2018, in a counterpart European patent application.
(Continued)

*Primary Examiner* — Ismael Negron
(74) *Attorney, Agent, or Firm* — Metrolex IP Law Group, PLLC.

(57) ABSTRACT

A lighting device includes a body defining a central axis, a reflector defining an optical axis at an angle with respect to the central axis, and a planar light source defining a surface inclined with respect to a first plane orthogonal to the optical axis. The optical axis being inclined towards one side of the central axis such that the light emission direction of the planar light source is inclined towards an opposite side with respect to the central axis.

4 Claims, 9 Drawing Sheets

(51) Int. Cl.

| | |
|---|---|
| ***F21V 7/06*** | (2006.01) |
| ***F21V 7/08*** | (2006.01) |
| ***F21V 7/09*** | (2006.01) |
| *F21Y 105/16* | (2016.01) |
| *F21Y 115/10* | (2016.01) |
| *F21Y 105/10* | (2016.01) |

(52) U.S. Cl.
CPC ..... *F21Y 2105/10* (2016.08); *F21Y 2105/16* (2016.08); *F21Y 2115/10* (2016.08)

(56) References Cited

U.S. PATENT DOCUMENTS

| | | | | | |
|---|---|---|---|---|---|
| 4,623,956 | A * | 11/1986 | Conti | F21V 21/30 | 362/148 |
| 5,457,617 | A * | 10/1995 | Chan | F21V 21/30 | 362/148 |
| 6,779,908 | B1 * | 8/2004 | Ng | F21S 8/02 | 362/147 |
| 6,969,181 | B1 * | 11/2005 | Bailey | F21S 2/00 | 362/147 |
| 6,994,456 | B1 * | 2/2006 | Russo | F21S 8/02 | 362/147 |
| 7,217,009 | B2 * | 5/2007 | Klose | F21S 8/024 | 362/297 |
| 7,303,314 | B2 * | 12/2007 | Jones | F21S 8/02 | 362/282 |
| 7,607,794 | B1 * | 10/2009 | Thompson | F21V 7/005 | 362/147 |
| 8,038,321 | B1 * | 10/2011 | Franck | F21S 8/026 | 362/249.02 |
| 2007/0103894 | A1 * | 5/2007 | Klose | F21S 8/026 | 362/147 |

FOREIGN PATENT DOCUMENTS

| | | | |
|---|---|---|---|
| JP | 2003-208803 | A | 7/2003 |
| JP | 2011-129473 | A | 6/2011 |
| JP | 2012-028236 | A | 2/2012 |
| WO | 2010/103450 | A1 | 9/2010 |

OTHER PUBLICATIONS

The Office Action (EPOA) dated Oct. 12, 2018, in a counterpart European patent application.

* cited by examiner

LIGHTING DEVICE WITH OFF-AXIS REFLECTOR AND LIGHT SOURCE

TECHNICAL FIELD

The present invention relates to a lighting device that is embedded in a ceiling surface and illuminates a wall surface.

BACKGROUND

Patent Document 1 (JP-A-2012-28236) discloses a lighting device that uses what we call a planar light source (LED surface light source) for a light source, whose light-emitting surface (light-emitting portion) has a two-dimensional extent.

This lighting device comprises a reflector having a substantially bowl-like shape to cover a front portion of the light-emitting surface. In this lighting device, the central axis of the lighting device coincides with the axis of the reflector, and the light-emitting surface is disposed orthogonal to these axes.

In this lighting device, the light emitted from the light-emitting surface is reflected by the reflector, and a circular illuminated region (illuminated range) is formed, centering around the central axis of the lighting device and the axis of the reflector. This lighting device may be used for, for example, a spotlight, or a downlight that is installed in a ceiling surface for illuminating mainly an area immediately below the lighting device.

PRIOR ART DOCUMENT

Patent Document 1:JP-A-2012-28236

SUMMARY OF THE INVENTION

Problems to be Solved By the Invention

The lighting device described in JP-A-2012-28236 is designed to provide an optimal orientation when light is to be emitted mainly centering at the axis of the reflector of a spotlight, downlight, or the like. In other words, the light-emitting surface is oriented orthogonal to the axis of the reflector.

However, in a case where a wall surface needs to be illuminated in a vertically wider range, in other words, in a case where the illumination needs to be provided in a direction other than the direction along the axis of the reflector, the light from the light-emitting surface may not always be effectively used.

The present invention is provided in view of the issue described above, and aims to provide a lighting device body and a lighting device that can effectively use the light from a light-emitting surface, for example when a wall surface or the like is to be illuminated in a vertically wide range.

Means for Solving the Problems

A lighting device body according to one or more embodiments, which is recessed in a ceiling surface when it is used, with its central axis being oriented in a vertical direction, includes: a planar light source having a light-emitting surface; and a reflector formed in a bowl-like shape centering around an axis that intersects the central axis, the reflector being disposed so as to cover a lower portion of the light-emitting surface. The reflector is disposed in an inclined orientation in which a lower portion of the axis of the reflector is located nearer to a wall surface, and the light-emitting surface is disposed with its center being located on the axis, and the light-emitting surface is inclined such that, when a first virtual plane being orthogonal to the axis is used as a reference plane, a portion of the light-emitting surface farther from the wall surface is relatively upper than a portion of the light-emitting surface closer to the wall surface.

In the lighting device body, when viewed in a cross section cut along a plane that includes the central axis and the axis, and when an inclination angle of the axis with respect to the central axis is defined as a and an inclination angle of the light-emitting surface with respect to the first virtual plane is defined as β, the reflector and the light-emitting surface are disposed to satisfy a relationship between α and β as expressed in:

$$\alpha<\beta<90 \text{ degrees.}$$

In the lighting device body, the reflector is deviated with respect to the central axis such that the center of the light-emitting surface is located farther from the wall surface than the central axis.

A lighting device according to one or more embodiments includes: a body attachment member secured to an attachment hole provided in a ceiling surface; and a lighting device body detachably attachable to the body attachment member.

Effect of the Invention

According to the invention of claim 1, the reflector is disposed in an inclined orientation in which the lower portion of the axis of the reflector is located nearer to the wall surface, and the light-emitting surface is inclined such that, when the first virtual plane being orthogonal to the axis is used as a reference plane, a portion of the light-emitting surface farther from the wall surface is located upper than a portion of the light-emitting surface closer to the wall surface. In other words, the light-emitting surface is oriented toward a portion of the reflector located farther from the wall surface than the axis. With this configuration, among the amount of light emitted from the light-emitting surface, the amount of light provided toward the portion of the reflector farther from the wall surface is increased.

According to the invention of claim 2, when the inclination angle of the axis of the reflector with respect to the central axis is defined as a and the inclination angle of the light-emitting surface with respect to the first virtual plane is defined as β, a relationship is obtained between α and β as expressed in:

$$\alpha<\beta<90 \text{ degrees.}$$

The equation α=β herein represents a case where the light-emitting surface is in the horizontal direction and is orthogonal to the central axis that is in the vertical direction. The equation β=90 degrees herein represents a case where the inclination angle of light-emitting surface is the same as the inclination angle of the axis. By inclining the light-emitting surface between these angles, the increase in the amount of the light provided toward a portion of the reflector farther from the wall surface, among the amount of the emitted light, can be adjusted.

According to the invention of claim 3, the axis of the reflector is inclined with respect to the central axis of the lighting device body. This reflector configuration can reduce the difference between the distance from the central axis to the portion of the reflector farthest from the central axis, and the distance from the central axis to the portion of the reflector closest to the central axis. In other words, since the axis of the reflector is inclined with respect to the central axis of the lighting device body, if one tries to locate the center of the light-emitting surface that is located on the axis of the reflector further onto the central axis of lighting device body, a substantial radius of the reflector with respect to the central axis of the lighting device body can be inadvertently increased. In contrast, by deviating the light-emitting surface and the reflector from the central axis by an appropriate distance, the substantial radius of the reflector with respect to the central axis can be minimized.

According to the invention of claim 4, advantages of the lighting device body described above can be attained as a lighting device that comprises the lighting device body and a body attachment member that detachably and attachably holds the lighting device body.

EMBODIMENTS FOR IMPLEMENTING THE INVENTION

Figure 1:
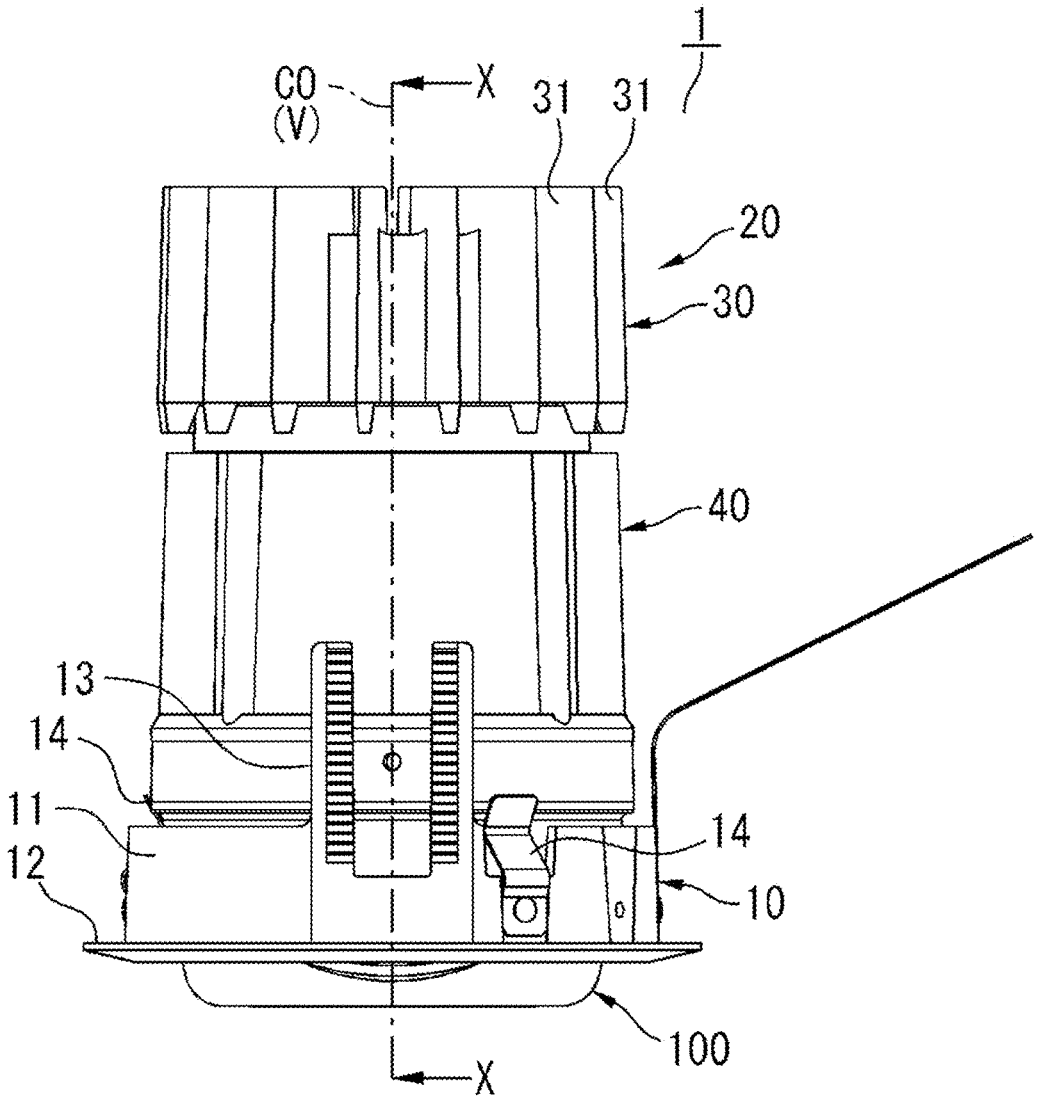
FIG. 1 is a front view of a lighting device.

Embodiments to which the present invention is applied are described in detail with reference to the drawings. Elements designated by the same reference numerals in the drawings have a same or similar configuration, and duplicate explanation thereof is omitted. In the drawings, elements that are unnecessary for explanation are omitted as appropriate, and not shown.

Embodiment 1

A lighting device 1 and a lighting device body 20 according to Embodiment 1, to which the present invention is applied, are described with reference to FIGS. 1 to 9.

An overview of the configuration of the lighting device 1 is described with reference to FIGS. 1 to 4, and 8.

Figure 2:
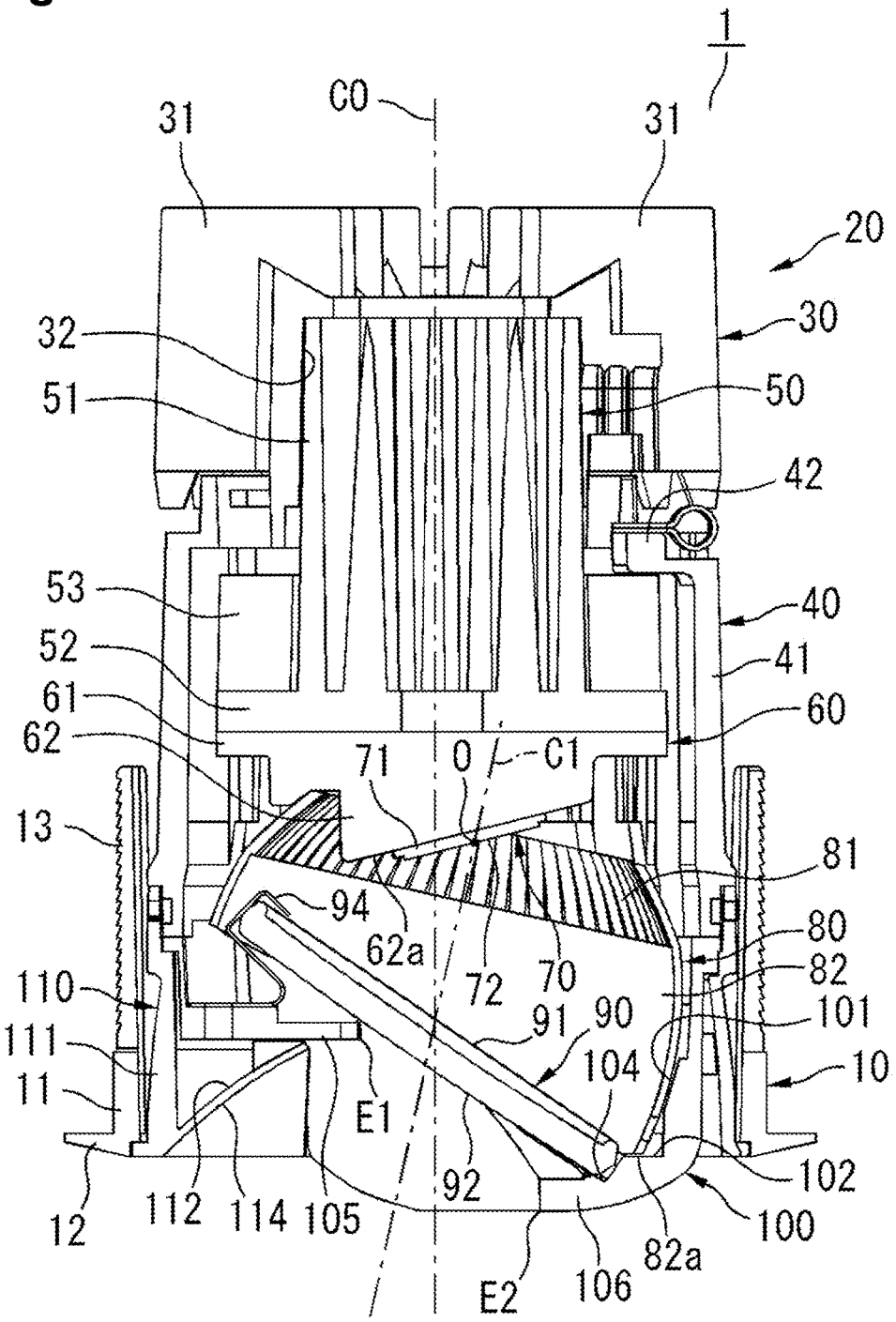
FIG. 2 is an enlarged view, viewed along X-X line in FIG. 1.
Figure 3:
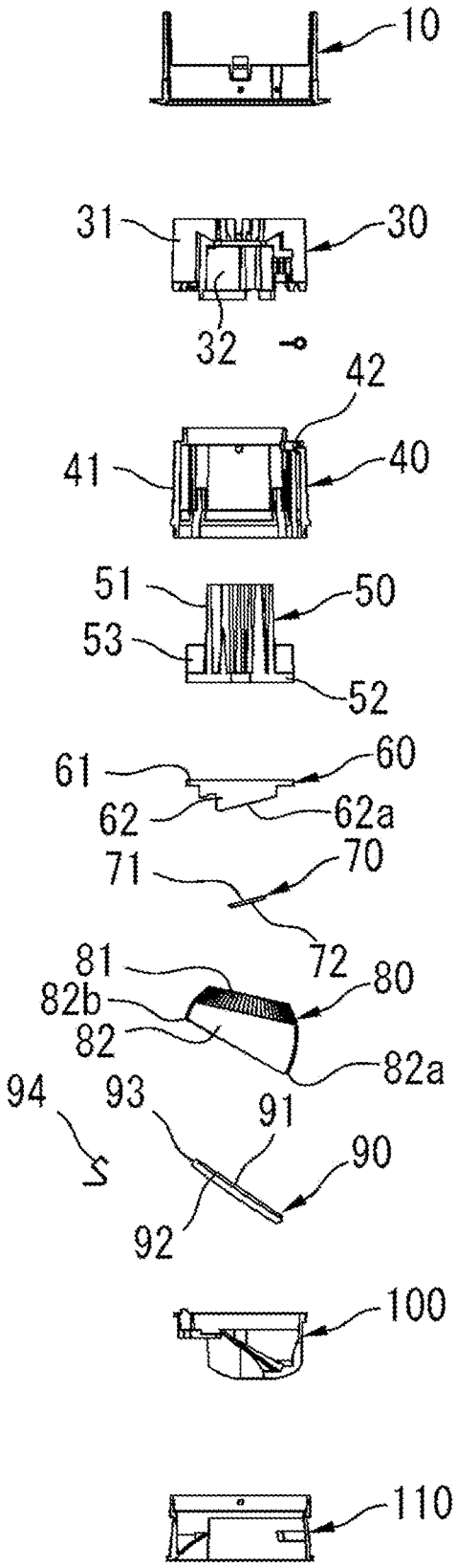
FIG. 3 is an exploded shrunken view, viewed along X-X line in FIG. 1.
Figure 4:
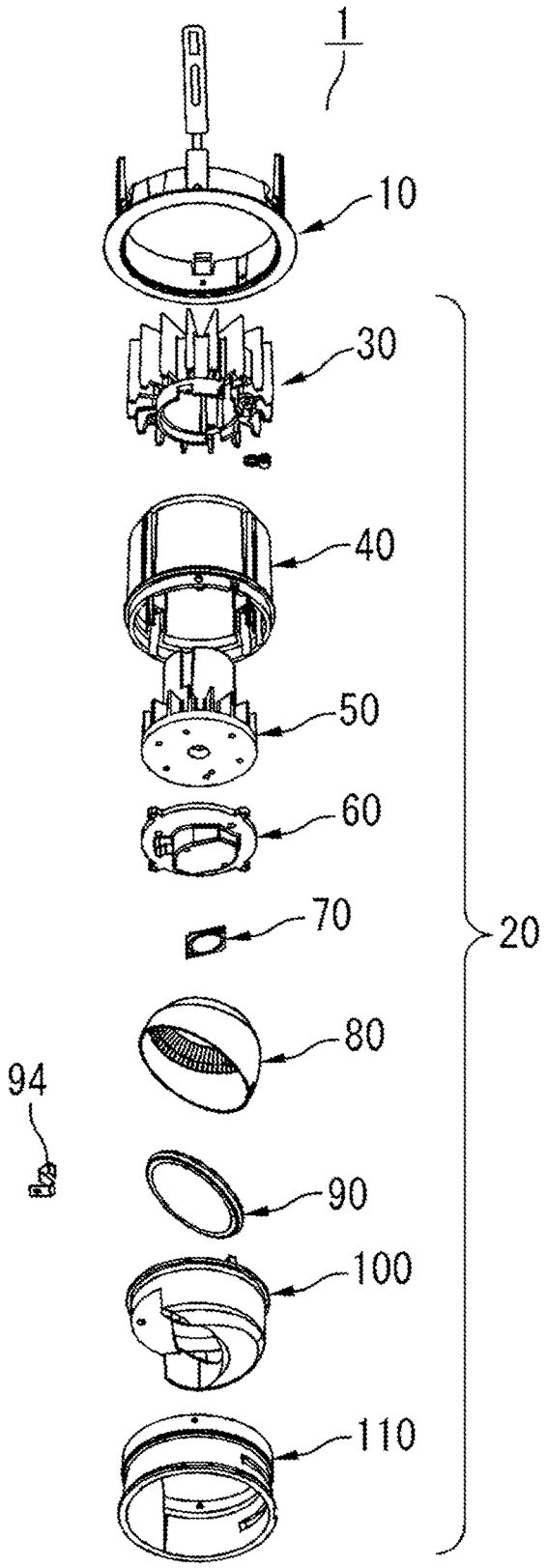
FIG. 4 is an exploded oblique view of a lighting device, viewed from obliquely below.
Figure 8:
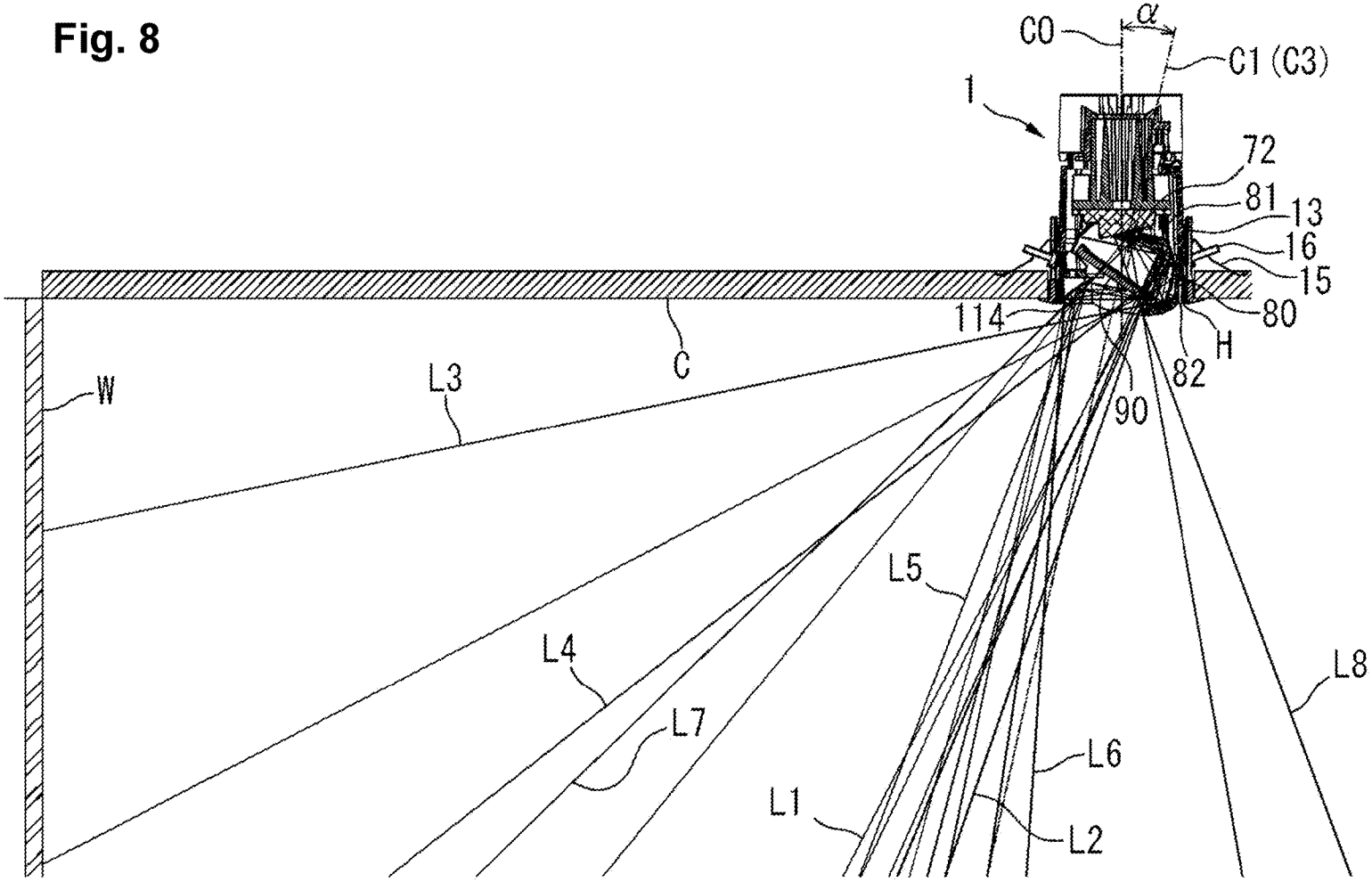
FIG. 8 illustrates light paths of the light emitted from a lighting device.

FIG. 1 is a front view of the lighting device 1. FIG. 2 is an enlarged view, viewed along X-X line in FIG. 1. In other words, FIG. 2 is a cross sectional view, cut along a plane V that is orthogonal to a wall surface W (see FIG. 5) and that includes the central axis C0 of the lighting device body 20. The wall surface W is flat and in the vertical direction. An axis C1, a straight line C2, and a rotation axis C3 described later are located on the plane V. FIG. 3 is an exploded shrunken view, viewed along X-X line in FIG. 1. FIG. 4 is an exploded oblique view of the lighting device 1, viewed from obliquely below. FIG. 8 illustrates light paths of the light emitted from the lighting device 1.

In examples described below, the lighting device 1 is what we call a wall washer, which illuminates mainly the wall surface W.

The lighting device 1 comprises a recessed frame (body attachment member) 10 and a lighting device body 20. The lighting device body 20 comprises a planar light source 70, a reflector 80, etc.

The recessed frame 10 comprises a tubular portion 11, a flange portion 12 at the lower end of the tubular portion 11, two sets of mounting bases 13, three fixing springs 14, two recessed frame springs 15 (see FIG. 8), and two fixing screws 16.

The recessed frame 10 is secured to a ceiling surface C as illustrated in FIG. 8, by inserting the tubular portion 11 into an attachment hole H provided in the ceiling surface C, with the flange portion 12 being in contact with the ceiling surface C, and using the recessed frame springs 15 and the fixing screws 16 that are provided to the mounting bases 13.

In this condition, the recessed frame 10 holds the lighting device body 20, with a portion of the fixing springs 14 protruding inside the tubular portion 11, and this protruding portion being engaged with a cone 110 described later in the lighting device body 20.

The lighting device body 20 comprises the planar light source 70 and the reflector 80 as described above, and further comprises a socket 30, a body 40, a light source mounting member 50, a base 60, a diffusion plate 90, a cover 100, and a cone (holding member) 110, which are integrally formed.

The socket 30 comprises multiple cooling fins 31 that radially extend and that are disposed along a circumferential direction. The socket 30 further comprises a concave portion 32 that opens downward.

The body 40 comprises a tubular portion 41, and a small diameter portion 42 at the upper end of the tubular portion 41.

The light source mounting member 50 comprises a tubular portion 51, a circular plate portion 52 at the lower end of the tubular portion 51, and multiple cooling fins 53 radially disposed on the top surface of the circular plate portion 52.

The light source mounting member 50 is inserted from below into the body 40 such that the upper end of the cooling fin 53 is in contact with the small diameter portion 42 of the body 40, and such that the tubular portion 51 protrudes from the tubular portion 41 of the body 40. This protruding portion is inserted into the concave portion 32 of the socket 30. With this configuration, the cooling fins 53 of the light source mounting member 50 and the cooling fins 31 of the socket 30 are disposed substantially continuously, thereby multiple flow paths for cooling air are provided radially.

The base 60 comprises a circular plate portion 61, and a mounting portion 62 that protrudes downward from the circular plate portion 61. The circular plate portion 61 is secured to the circular plate portion 52 of the light source mounting member 50 from below. The lower surface of the mounting portion 62 becomes a light source mounting surface 62*a* that is inclined as described later in detail, and the planar light source 70 is mounted in an inclined orientation to the light source mounting surface 62*a*.

The planar light source 70 is mounted to the light source mounting surface 62*a* of the base 60.

The reflector 80 is formed in a substantially bowl-like shape, and disposed in an inclined orientation to cover the lower portion of the planar light source 70. An opening portion of the reflector 80 is cut obliquely, and the diffusion plate 90 is provided to this opening portion.

The diffusion plate 90 is formed in a substantially circular plate shape, and supported by the cover 100, and secured by using a fixing metal 94.

The cover 100 supports the reflector 80 and the diffusion plate 90 from below.

The cone 110 supports the cover 100, and is secured to the body 40, with the cone 110 supporting the reflector 80 and the diffusion plate 90 through the cover 100.

The aforementioned lighting device body 20 is formed in a substantially tubular shape, in which the components, the socket 30 through the cone 110, are integrally combined. The lighting device body 20 is mounted to the recessed frame 10, by inserting the lighting device body 20 into the recessed frame 10 from below so that the fixing springs 14 are engaged with the cone 110. At this time, the central axis C0 of the lighting device body 20 is oriented in the vertical direction. The explanation of the overview of the configuration of the lighting device 1 ends here.

The components, the base 60 trough the cone 110, are now described in detail with reference to FIG. 2, and FIGS. 5 to 7.

Figure 5:
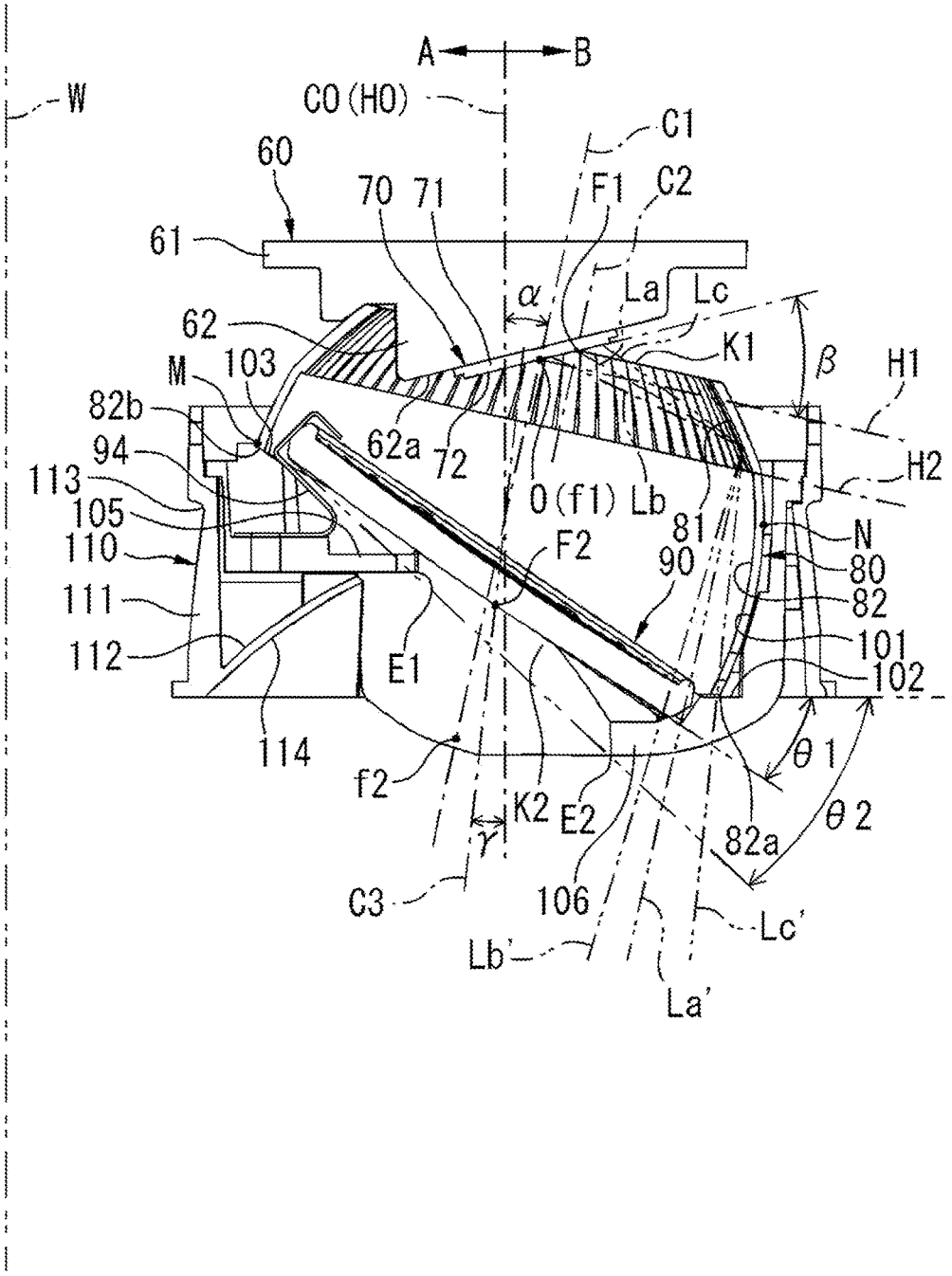
FIG. 5 is an enlarged view illustrating a base, a planar light source, a reflector, a diffusion plate, a cover, and a cone, viewed along X-X line in FIG. 1.
Figure 6:
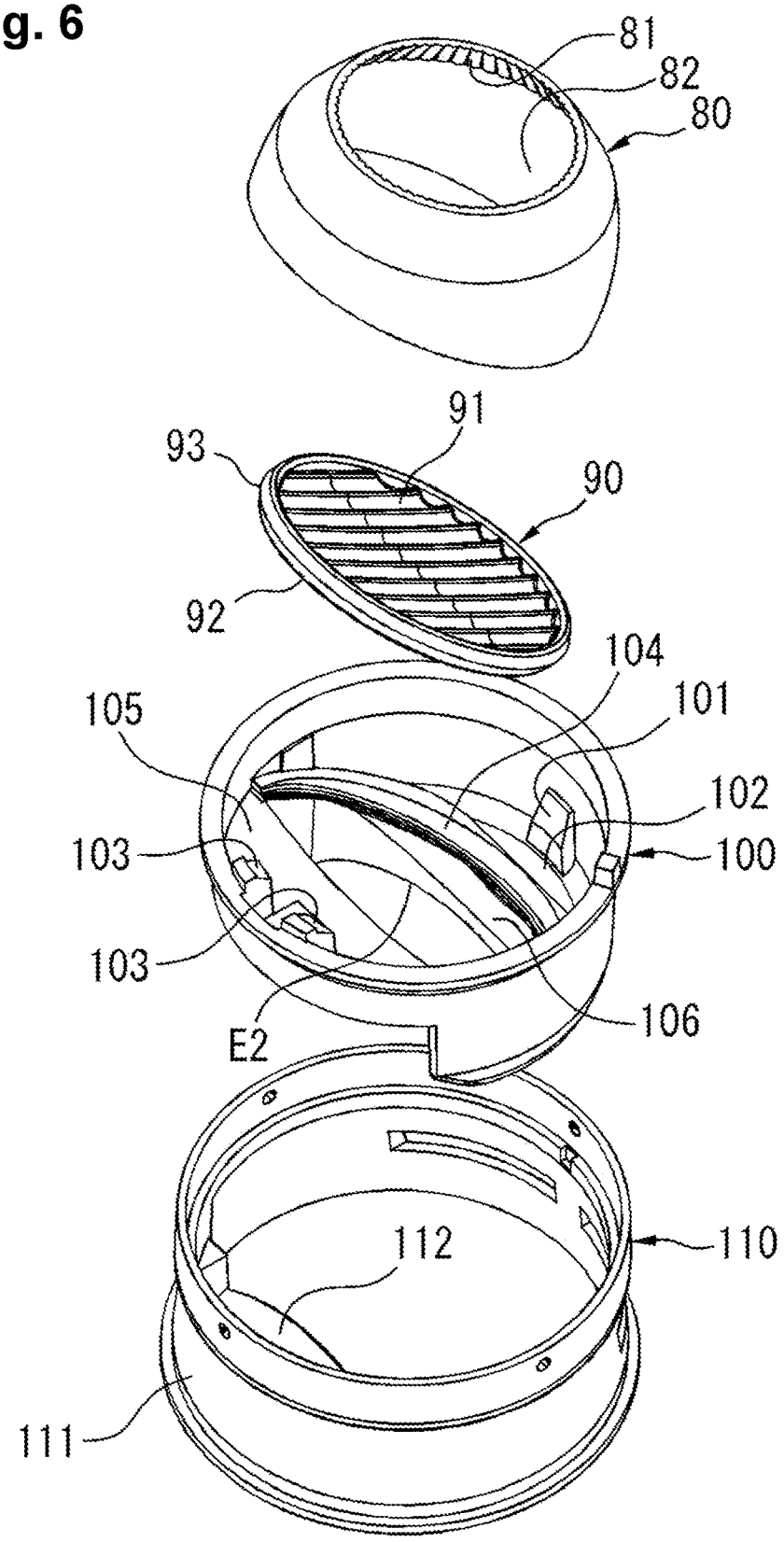
FIG. 6 is an exploded oblique view illustrating a reflector, a diffusion plate, a cover, and a cone, viewed from obliquely above.
Figure 7:
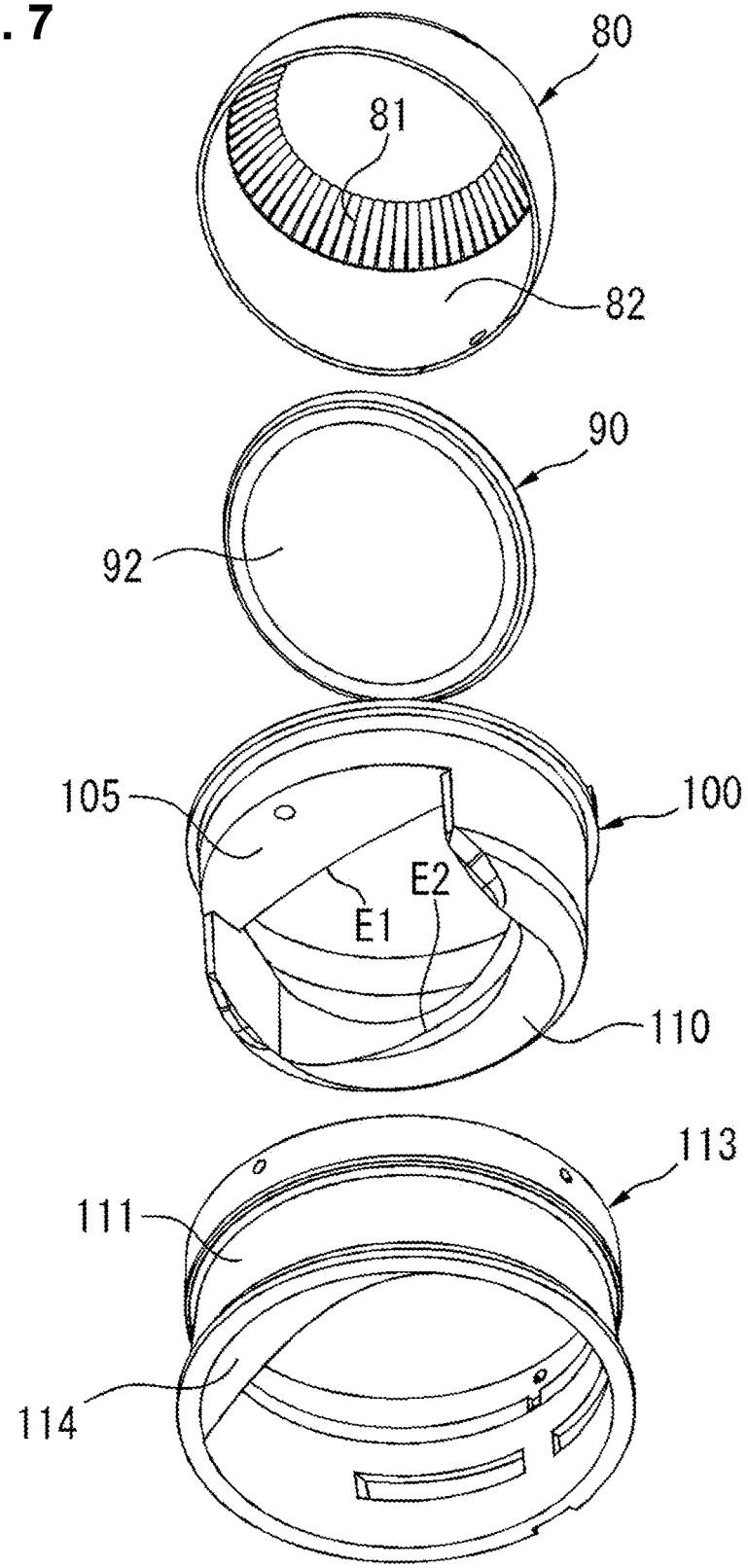
FIG. 7 is an exploded oblique view illustrating a reflector, a diffusion plate, a cover, and a cone, viewed from obliquely below.

FIG. 2 is an enlarged view, viewed along X-X line in FIG. 1. FIG. 5 is an enlarged view illustrating the base 60, the planar light source 70, the reflector 80, the diffusion plate 90, the cover 100, and the cone 110, viewed along X-X line in FIG. 1. FIG. 6 is an exploded oblique view illustrating the components, the reflector 80 through the cone 110, viewed from obliquely above. FIG. 7 is also an exploded oblique view illustrating the components, the reflector 80 through the cone 110, viewed from obliquely below.

In the present embodiment, relative positioning of the light source mounting surface 62*a* of the planar light source 70 in the base 60, and the reflector 80 is designed as illustrated in FIG. 5.

In other words, on a cross section cut along the plane V, the axis C1 of the reflector 80 is inclined at the inclination angle α with respect to the vertical central axis C0 of the lighting device body 20. The light-emitting surface 72 of the planar light source 70 is inclined at the inclination angle β with respect to the first virtual plane H1, which is orthogonal to the axis C1 and which passes through the center O of the light-emitting surface 72. The center O of the light-emitting surface 72 is not located on the central axis C0, and is deviated from the central axis C0. The configuration of these components is described below in detail.

In FIG. 5, the central axis C0 of the lighting device body 20 (see FIG. 2) is oriented in the vertical direction. A surface that is parallel to the wall surface W and that includes the central axis C0 is now defined as a reference surface H0. A portion closer to the wall surface W than the reference surface H0 is defined as A-side, and a portion farther from the wall surface W than the reference surface H0 is defined as B-side. For example, the A-side of the reflector 80 refers to a side (portion) of the reflector 80 closer to the wall surface, and the B-side of the reflector 80 refers to a side (portion) of the reflector 80 farther from the wall surface W. Other components may be referred to similarly.

The base 60 comprises the circular plate portion 61, and the mounting portion 62 protruding downward from the circular plate portion 61, as illustrated in FIG. 5. The lower surface of the mounting portion 62 becomes the light source mounting surface 62*a*, to which the planar light source 70 is to be mounted. The light source mounting surface 62*a* is formed in a planar shape, and inclined (inclined surface) such that the B-side is located upper than the A-side.

The planar light source 70 is an LED module of what we call COB (chip on board) type, in which multiple small LED devices are arranged in a planar configuration. An example of the planar light source 70 is, for example, a planar light source available from CITIZEN ELECTRONICS Co. Ltd. This planar light source may comprise, for example, an aluminum substrate 71 having a square shape, and a circular light-emitting surface 72 that is inscribed in the square. The light-emitting surface 72 is formed by arranging multiple LED devices in a square configuration on the substrate 71 and then encapsulating the surface with a phosphor-containing silicone resin. The planar light source 70 has an enhanced cooling efficiency, because it is directly secured to the mounting portion 62, with the substrate 71 being adhered to the light source mounting surface 62*a* of the base 60. The planar light source 70 emits light at an irradiation angle 120° from each of the LED devices, and the aggregation of the light from the LED devices works as a planar light source.

Regarding the planar light source 70, the back surface of the substrate 71 being in contact with the light source mounting surface 62*a* of the base 60 and the light-emitting surface 72 are formed in parallel to each other, and thus the inclination angle β of the light-emitting surface 72 becomes the same as the inclination angle of the light source mounting surface 62*a* of the base 60.

The reflector 80 is formed in a substantially bowl-like shape centering around the axis C1, and the reflector 80 has an opening K1 at the upper end, and has an opening K2 at the lower end.

The axis C1 of the reflector 80 intersects the central axis C0 of the lighting device body at the inclination angle β (where, $0<\alpha<90$ degrees) with respect to the central axis C0. In addition, when a plane orthogonal to the axis C1 is defined as the first virtual plane H1, the aforementioned light-emitting surface 72 is inclined at the inclination angle β (where, $0<\beta<90$ degrees) with respect to the first virtual plane H1.

In addition, in the present embodiment, the light-emitting surface 72 and the reflector 80 are configured to obtain a relationship between these inclination angles α, β, as expressed in:

$$\alpha \leq \beta < 90 \text{ degrees.}$$

With this configuration, the light-emitting surface 72 is oriented toward a portion of the reflector 80 being located on the B-side. As a result, among the amount of light emitted from the light-emitting surface 72, the amount of light provided toward the portion of the reflector 80 located on the B-side is increased. Therefore, the amount of light that is reflected at that portion and directed toward the wall surface W can be increased.

The equation $\alpha=\beta$, when a is fixed, represents a case where the light-emitting surface 72 is orthogonal to the central axis C0. Even in this case, the light-emitting surface 72 has the inclination angle α with respect to the axis C1, and thus the amount of light directed toward the wall surface W can be increased, similarly to the case described above.

In addition, in the present embodiment, the center O of the light-emitting surface 72 is deviated from the central axis C0 of the lighting device body 20. As a result, the reflector 80 being disposed in an inclined orientation is located within a minimum radius when the central axis C0 is used as its center. In other words, for example when a portion of the reflector 80 that is located farthest from the central axis C0, among the portion located on the A-side, is defined as a portion M, and when a portion of the reflector 80 located farthest from the central axis C0, among the portion located on the B-side, is defined as a portion N, the center O of the light-emitting surface 72 is deviated from the central axis C0 such that the distances from the central axis C0 to the portion M and to the portion N become equal. With this configuration, the entire reflector 80 being disposed in an inclined orientation can be located within a virtual cylindrical space having a minimum radius. In other words, waste of space can be avoided, and space efficiency can be improved.

The aforementioned reflector 80 comprises a first reflection surface 81 having a shape of a paraboloid of revolution, and a second reflection surface 82 having a shape of an ellipsoid of revolution, both located on the inner surface of the reflector 80. If a second virtual plane (virtual plane) H2 orthogonal to the axis C1 is used as a reference plane, then the first reflection surface 81 is formed in a portion upper than H2 (a portion closer to the planar light source 70), and the second reflection surface 82 is formed in a portion lower than H2 (a portion farther from the planar light source 70).

The first reflection surface 81 is formed in a shape of a paraboloid of revolution that is obtained by rotating a portion of a parabola around the axis C1. The parabola is symmetric with respect to the straight line C2 that is parallel to the axis C1, and has a focus F1 on the straight line C2. The focus F1 is located at an intersection with the straight line C2 on the light-emitting surface 72. If the radius of the light-emitting surface 72 is defined as r, then the focus F1 is located at a range of about r/4 to 3r/4, for example, about r/2, from the center O. In a case where the light-emitting surface 72 is not circular, and is square for example, then an inscribed circle thereof can be considered instead.

In the examples described above, the straight line C2 is located in parallel to the axis C1. Alternatively, the straight line C2 may coincide with the axis C1, or may be inclined with respect to the axis C1.

In the present embodiment, the light-emitting surface 72 of the planar light source 70 is inclined at the inclination angle β with respect to the first virtual plane H1, and the focus F1 is deviated from the center of light-emitting surface 72, as described above. As a result, when the center O is defined as a point of origin, and a direction orthogonal to the axis C1 and passing through the center O is defined as x-axis, and a direction of the axis C1 is defined as y-axis, then the focus F1 has an x coordinate (x component) and a y coordinate (y component) along the x-axis and y-axis.

With this configuration, the reflector 80 can obtain light paths Lb, Lb' illustrated in FIG. 5, that cannot be obtained when the focus F1 coincides with the center O of the light-emitting surface 72.

In other words, as illustrated in FIG. 5, a case is considered, in which each of the light that goes out from the focus F1 on the light-emitting surface 72 and passes through the light path La, the light that goes out from a portion on the light-emitting surface 72 inner than the focus F1 (the portion closer to the axis C1) and passes through the light path Lb, and the light that goes out from a portion on the light-emitting surface 72 outer than the focus F1 (the portion farther from axis C1) and passes through the light path Lc strikes on a same point of the first reflection surface 81, and is reflected at that point. The light, which passed through each of the light paths La, Lb, Lc and was then reflected, passes through the light paths La', Lb', Lc', respectively, after the reflection. The light path La' is the light that goes out from the focus F1 and then is reflected at the first reflection surface 81, and thus the light path La' is in parallel to the axis C1. The light path Lb' is located inner with respect to the light path La' (closer to the wall surface W), whereas the light path Lc is located outer with respect to the light path La' (farther from the wall surface W). Regarding these light paths Lb', Lc', if the focus F1 coincides with the center O of the light-emitting surface 72, then the light path that is similar to the light path Lc' can be obtained, but the light path that is similar to the light path Lb' cannot be obtained because there is no light-emitting portion in the portion inner than the focus F1.

In the present embodiment, the light paths Lb, Lb' can be provided as described above. Therefore, for example, in a case where the light that passes through the light path La' mainly illuminates a floor surface F, then the light path Lb' can illuminate a region that is adjacent to, and that is closer to the wall surface W than, the region on the floor surface F being illuminated by the light that passed through the light path La'. In addition, for example, in a case where the light that passes through the light path La' mainly illuminates the wall surface W near the floor surface F, then the light path Lb' can illuminate a region on the wall surface W that is adjacent to, and that is upper than, the region being illuminated by the light that passed through the light path La'. In either case, the light that passes through the light path Lb' can favorably illuminate a region adjacent to the region being illuminated by the light that passes through the light path La', with the light having an enhanced controllability.

The second reflection surface 82 is formed in a shape of an ellipsoid of revolution that is obtained by rotating a portion of an ellipse around the axis C1. An upper focus f1 and a lower focus f2 of the ellipse are both located on the axis C1. The focus f1 is located at the center O of the light-emitting surface 72, and the focus f2 is located at a portion lower than a portion 82*a* on the lower edge (the portion located at the lowest portion on the lower edge) of the second reflection surface 82. The lower end of the second reflection surface 82 is cut by a virtual plane that is inclined with respect to the axis C1 such that the A-side is located upper than the B-side, thereby an opening K2 is formed. With this configuration, reflected light can be diffused in a circumferential direction.

In the examples described above, the focuses f1, f2 are located on the axis C1. Alternatively, at least one of the focuses f1, f2 may be deviated from the axis C1. In other words, in the examples described above, the longer axis of the ellipse, which becomes the basis of the second reflection surface 82, coincides with axis C1. However, the longer axis may be in parallel to the axis C1 or may be inclined with respect to the axis C1, instead.

The aforementioned first reflection surface 81 is knurled such that multiple convex portions and convex portions, each of which intersects the circumferential direction, are provided along the circumferential direction. With this configuration, reflected light can be diffused in the circumferential direction. On the other hand, the second reflection surface 82 is faceted, which allows the reflected light to be diffused both in the circumferential direction and in the vertical direction that intersects the circumferential direction.

A diffusion plate 90 is provided to the lower opening K2 of the reflector 80.

The diffusion plate 90 is formed into a circular plate shape, as illustrated in FIG. 6. The diffusion plate 90 comprise a filter 91 on the front surface (top surface), and a diffusion glass 92 on the back surface. The filter 91 is for expanding the direct light from the light-emitting surface 72, and the reflected light from the first reflection surface 81 and from the second reflection surface 82 toward the wall surface W horizontally. The diffusion glass 92 is for diffusing the light that passed through the filter 91.

The diffusion plate 90 is supported by the cover 100, together with the reflector 80.

As illustrated in FIGS. 5 and 6, the cover 100 comprises, on the B-side, a contact portion 101 having a steep slope, and a mounting portion 102 having a horizontal surface. On the A-side, the cover 100 comprises two mounting portions 103 each having a gentle slope. The cover 100 further comprises an arc-shaped stepped portion 104 located both on the B-side and the A-side. The stepped portion 104 is inclined such that the A-side is located upper than the B-side. The reflector 80 is supported such that the outer periphery surface of the reflector 80 on the B-side is in contact with the contact portion 101, and the aforementioned portion 82*a* on the lower edge is disposed on the mounting portion 102, and a portion near a portion 82*b* (the portion located upper most on the lower edge) of the lower edge is disposed on the mounting portion 103. On the other hand, more than half of a circumferential edge portion 93 of the diffusion plate 90 is engaged with the stepped portion 104, and a portion of the diffusion plate 90 located on the A-side is secured by using the fixing metal 94.

The cover 100 further comprises a first light-shading portion 105 on the A-side, and a second light-shading portion 106 on the B-side. The first light-shading portion 105 is disposed in an upper portion in the cover 100. An edge E1 having a gentle concave shape that faces the central axis C0 is formed at the inner edge of first light-shading portion 105. The second light-shading portion 106 is disposed at the lower end in the cover 100, and an edge E2 having a gentle concave shape that faces the central axis C0 is formed at the inner edge of the second light-shading portion 106. These edges E1, E2 oppose each other interposing the central axis C0 when viewed from a lower surface (when viewed from below), thereby an opening is formed. The opening is longer in a direction along the wall surface W than in a direction orthogonal to the wall surface W.

These edges E1, E2 regulate cut-off angles. In particular, the edge E2 increases a cut-off angle θ2 when a user approaches the wall surface W. Without the light-shading portion 106, the inclination angle of the diffusion plate 90 becomes a cut-off angle θ1. In contrast, when the light-shading portion 106 is formed such that it protrudes toward the central axis C0, the edge E2 increases the cut-off angle θ2.

The cone (holding member) 110 comprises a tubular portion 111 and a reflection portion 112. The tubular portion 111 comprises a stepped portion (engagement concave portion) 113 near the upper end of the tubular portion 111. The fixing spring 14 of the recessed frame 10 is resiliently engaged with the stepped portion 113 when the lighting device body 20 is mounted to the aforementioned recessed frame 10. This engagement enables the entire lighting device body 20 to be secured to the recessed frame 10 at a predefined position.

The reflection portion 112 extends obliquely upward from the lower end of the tubular portion 111 toward the central axis C0, and a reflection surface 114 is provided on the lower surface (inner surface) of the reflection portion 112. The reflection surface 114 is formed in a shape of a paraboloid of revolution that is obtained by rotating a portion of a parabola, which is located on the same plane as the central axis C0 is located, around the central axis C0. The focus F2 of the parabola is located at an intersection between the central axis C0 and the back surface of the diffusion plate 90. The reflection surface 114 is disposed at a location deviated from the light paths of the light reflected by the reflection surfaces 81, 82 of the reflector 80 on the B-side. Therefore, a portion of the light diffused by the diffusion plate 90 strikes on the reflection surface 114.

By providing the reflection surface 114 as described above, the amount of light directed toward the floor surface F (see FIG. 9) can be increased, and the controllability of the light can be improved.

When the axis of the rotation of the reflection surface 114 is defined as a rotation axis C3, the rotation axis C3 in the examples described above coincides with the central axis C0. Alternatively, the rotation axis C3 may coincide with the axis C1 of the reflector 80. Alternatively, the rotation axis C3 may be located between the central axis C0 and the axis C1. In other words, if the inclination angle of the rotation axis C3 with respect to the central axis C0 is defined as γ, then a relation may be obtained between the inclination angle γ and the inclination angle α of the axis C1 with respect to the central axis C0, as expressed in:

$$0 \leq \gamma \leq \alpha.$$

In any of these cases, the focus F2 of the reflection surface 114 should be at an intersection between the rotation axis C3 and the back surface of the diffusion plate 90.

The reflection surface 114 can improve the controllability of the light that is directed in a direction toward which the rotation axis C3 extends, regardless of the magnitude of the inclination angle γ.

Figure 9:
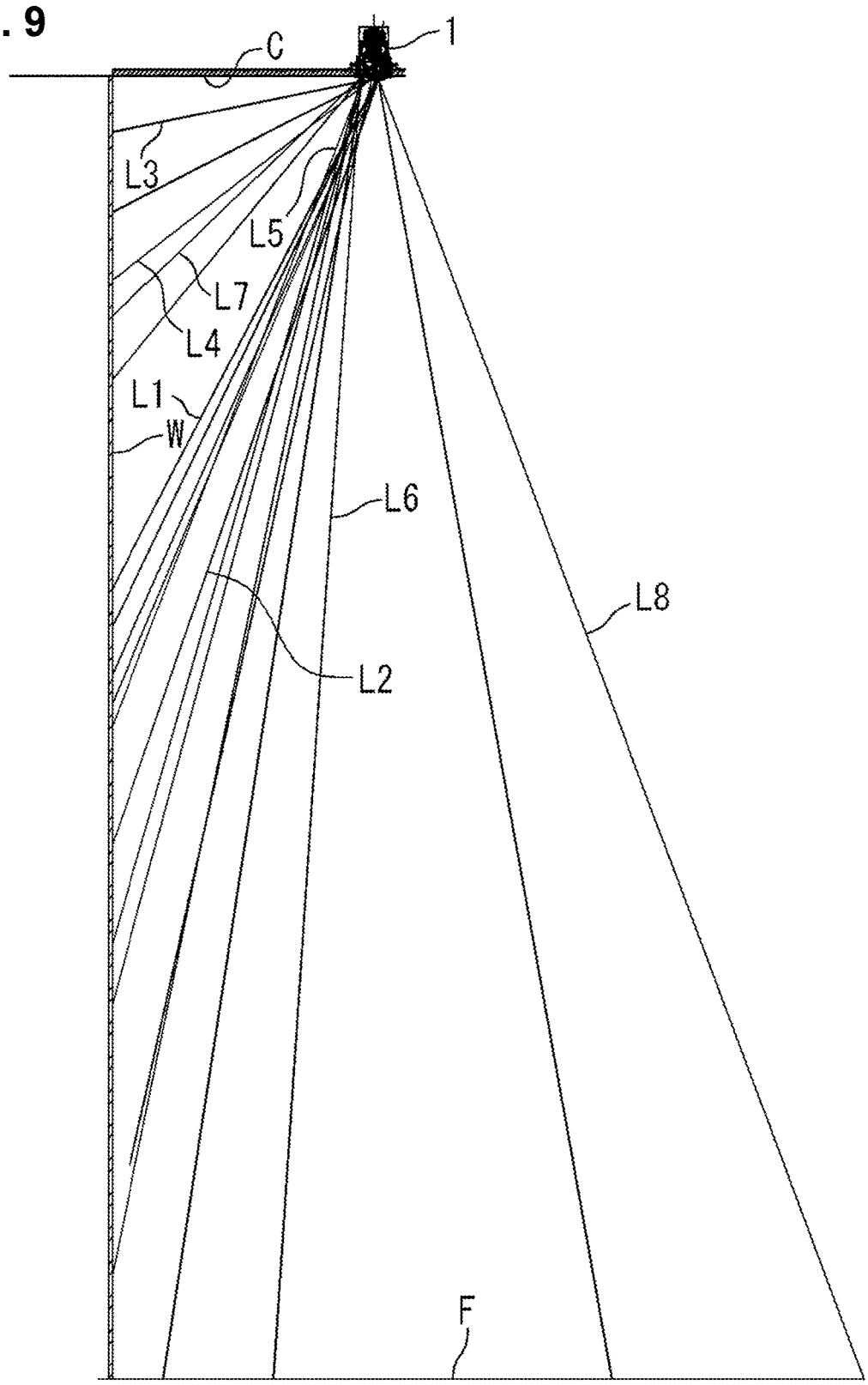
FIG. 9 illustrates light paths of the light emitted from a lighting device, and illuminated ranges.

FIG. 8 illustrates light paths of the light emitted from the lighting device 1 as described above. FIG. 9 illustrates light paths of the light emitted from the lighting device 1, and the illuminated ranges (regions). In the examples in FIGS. 8 and 9, the rotation axis C3 of the reflection surface 114 coincides with the axis C1 of the reflector 80.

As illustrated in FIG. 8, the light, which is emitted from the light-emitting surface 72 and reflected at the first reflection surface 81 of the reflector 80, passes through the diffusion plate 90, and passes mostly between a light path L1 and a light path L2.

The light, which is emitted from the light-emitting surface 72 and reflected at the second reflection surface 82 of the reflector 80, passes through the diffusion plate 90, and passes mostly between a light path L3 and a light path L4.

A portion of the light emitted from the light-emitting surface 72 and diffused by the diffusion plate 90 is reflected at the reflection surface 114, and passes mostly between a light path L5 and a light path L6.

The direct light emitted from the light-emitting surface 72 passes mostly between light paths L7 and L8.

As a result, for example when the lighting device 1 is installed at a height of 3000 mm from the floor surface F and at a distance of 600 mm from the wall surface W, the floor surface F and the wall surface W are illuminated by the light that passed through the aforementioned light paths L1 to L8. In particular, the wall surface W is illuminated evenly from near the ceiling surface C to near the floor surface F.

Effects and advantages of the lighting device body 20 and the lighting device 1 having the configuration as described above are summarized below.

The reflector 80 is disposed in an inclined orientation in which the lower portion of the axis C1 is closer to the wall surface W, and the light-emitting surface 72 of the planar light source 70 is inclined such that, when the first virtual plane H1 being orthogonal to the axis C1 is used as a reference plane, the portion farther from the wall surface W (B-side) is located relatively upper. In other words, the light-emitting surface 72 is oriented toward the portion of the reflector 80 being located farther from the wall surface W than the axis C1. With this configuration, among the light emitted from the light-emitting surface 72, the amount of light provided toward the portion of the reflector 80 farther from the wall surface W is increased.

When the inclination angle of axis C1 of the reflector 80 with respect to the central axis C0 is defined as a and the inclination angle of the light-emitting surface 72 with respect to the first virtual plane H1 is defined as β, a relation is obtained between α and β as expressed in:

$$\alpha \leq \beta < 90 \text{ degrees.}$$

The equation α=β herein represents a case where the light-emitting surface 72 is perpendicular to the vertical central axis C0 and is in the horizontal direction. The equation β=90 degrees herein represents a case where the inclination angle β of the light-emitting surface 72 becomes the same as the inclination angle α of the axis C1. By inclining the light-emitting surface 72 between these angles, the increase in the amount of light provided to the portion of the reflector 80 that is farther from the wall surface W, among the amount of the emitted light, can be adjusted.

The reflector 80 whose axis C1 is inclined with respect to the central axis C0 of the lighting device body 20 can minimize the difference between the distance from the central axis C0 to the portion M (or portion N) of the reflector 80 located farthest from the central axis C0, and the distance from the central axis C0 to the portion N (or portion M) located closest to the central axis C0. In other words, since the axis C1 of the reflector 80 is inclined with respect to the central axis C0 of the lighting device body 20, if one tries to locate the center of the light-emitting surface 72 being located on the axis C1 of the reflector 80 onto the central axis C0 of the lighting device body 20, a substantial radius of the reflector 80 with respect to the central axis C0 of the lighting device body 20 will be inadvertently increased. In contrast, by deviating the light-emitting surface 72 and the reflector 80 from the central axis C0 by an appropriate distance, a substantial radius of the reflector 80 with reference to the central axis C0 can be minimized.

The reflector 80 is inclined with respect to the lighting device body 20, and comprises the first reflection surface 81 having a shape of a paraboloid of revolution, and the second reflection surface 82 having a shape of an ellipsoid of revolution. Therefore, the controllability of the light in the direction of the axis C1 can be improved by the first reflection surface 81, and in the direction that intersects the axis C1 can be improved by the second reflection surface 82.

Regarding the first reflection surface 81, the focus F1 of the parabola is deviated from the center O of the light-emitting surface 72. Therefore, a region (range) inner (the portion closer to the wall surface W in FIG. 5) than the region (range) illuminated by the light, which goes out from the focus F1 and is reflected at the first reflection surface 81 and then passes in parallel to the axis C1, can be illuminated by the light that goes out from the portion of the light-emitting surface 72 inner than the focus F1. In addition, region (range) outer (the portion farther from the wall surface W in FIG. 5) than that region can be illuminated by the light that goes out from the portion of the light-emitting surface 72 outer than the focus F1.

Regarding the second reflection surface 82, the upper focus f1 of the ellipse is disposed within the light paths of the light that is emitted from the light-emitting surface 72 and then reaches the second reflection surface 82, and the lower focus f2 of the ellipse is disposed in a portion lower than the portion (lower edge) 82*a* on the lower edge of the second reflection surface 82. Therefore, the light, which is emitted from the light-emitting surface 72 and passed through the upper focus f1, is reflected at the second reflection surface 82, and passes through the lower focus f2, and then travels obliquely below.

In addition, the upper focus f1 and lower focus f2 are disposed on the axis C1, and the upper focus f1 is located at the center of the light-emitting surface 72. Therefore, the light that goes out from the center of the light-emitting surface 72 is reflected at the second reflection surface 82, and passes through the lower focus f2, and then travels obliquely below.

The first reflection surface 81 is knurled, and thus can diffuse the reflected light in a circumferential direction.

The second reflection surface 82 is faceted, and thus can diffuse the reflected light in a circumferential direction and in a direction perpendicular to the circumferential direction.

The cone (holding member) 110 comprises the reflection surface 114 having a shape of a paraboloid of revolution at a portion closer to the wall surface W than the axis C1. Therefore, the lighting device body 20 can add the reflected light from the reflection surface 114 to the reflected light from the reflector 80, and thus the controllability of the light to be illuminated can be improved.

By setting the inclination angle γ of the rotation axis C3 to satisfy a relation as expressed in:

$$0 \leq \gamma \leq \alpha,$$

the reflection surface 114 can set a direction, to which reflected light is to be directed, within this range.

The reflection surface 114 can reflect the light, which passed through the focus F2, toward a direction of the rotation axis C3.

By providing the diffusion plate 90, the reflection surface 114 can receive the light from the diffusion plate 90, and reflect the light, even when the reflection surface 114 cannot directly receive the reflected light from the reflector 80.

DESCRIPTION OF REFERENCES IN DRAWINGS

1: Lighting device
10: Recessed frame (body attachment member)
20: Lighting device body
30: Socket
40: Body
50: Light source mounting member
60: Base
70: Planar light source
72: Light-emitting surface
80: Reflector
81: First reflection surface
82: Second reflection surface
90: Diffusion plate
100: Cover
110: Cone (holding member)
114: Reflection surface
C: Ceiling surface
C0: Central axis C1: Axis
C3: Rotation axis
F1: Focus of a parabola
F2: Focus of a parabola
f1: Upper focus of an ellipse
f2: Lower focus of an ellipse
H1: First virtual plane
W: Wall surface
α: Inclination angle with respect to the central axis
β: Inclination angle of the light-emitting surface with respect to the first virtual plane
γ: Inclination angle of the rotation axis

The invention claimed is:

1. A lighting device comprising:

a body defining a central axis, the body configured to be mounted recessed on a ceiling surface with the central axis oriented in vertical direction;

a planar light source having a light-emitting surface defining a first plane and configured to emit light in a first direction, and a bowl-shaped reflector defining an optical axis that intersects the central axis at an angle, and disposed to cover a portion of the light-emitting surface, wherein the optical axis extends towards a first side of the central axis, and wherein the planar light source is configured such that a center point of the light-emitting surface is located on the optical axis, and the first plane is inclined with respect to a virtual plane orthogonal to the optical axis such that the first direction extends towards a second side of the central axis.

2. The lighting device according to claim 1, configured such that, in a cross section including the central axis and the optical axis, the reflector and the light-emitting surface are disposed such that:

$$\alpha<\beta<90 \text{ degrees},$$

where α is the angle between the central axis and the optical axis, and β is the angle between the first plane and the virtual plane.

3. The lighting device according to claim 1, configured such that the center point of the light-emitting surface is located on the second side of the central axis.

4. The lighting device according to claim 1, further comprising:

a body attachment member configured to removably secure the lighting device to an attachment hole provided in a ceiling surface.

* * * * *